US009266660B2

(12) United States Patent
Cai et al.

(10) Patent No.: US 9,266,660 B2
(45) Date of Patent: Feb. 23, 2016

(54) INSULATING CUP

(71) Applicant: Pactiv LLC, Lake Forest, IL (US)

(72) Inventors: Liming Cai, West Chester, PA (US); Michael G. Bodary, Downingtown, PA (US)

(73) Assignee: PACTIV LLC, Lake Forest, IL (US)

( * ) Notice: Subject to any disclaimer, the term of this patent is extended or adjusted under 35 U.S.C. 154(b) by 0 days.

(21) Appl. No.: 13/887,081

(22) Filed: May 3, 2013

(65) Prior Publication Data

US 2013/0292392 A1 Nov. 7, 2013

Related U.S. Application Data

(60) Provisional application No. 61/642,886, filed on May 4, 2012.

(51) Int. Cl.

| | |
|---|---|
| ***B65D 3/22*** | (2006.01) |
| ***B65D 3/14*** | (2006.01) |
| ***B65D 81/38*** | (2006.01) |
| ***B65D 21/02*** | (2006.01) |
| ***B65D 6/10*** | (2006.01) |

(52) U.S. Cl.

CPC ..... *B65D 81/3869* (2013.01); *B65D 3/14* (2013.01); *B65D 3/22* (2013.01); *B65D 11/16* (2013.01); *B65D 21/0233* (2013.01)

(58) Field of Classification Search

CPC ..... B65D 3/22; B65D 81/3869; B65D 3/14; B65D 21/0233; B65D 11/16

USPC ..... 220/592.16, 592.17, 592.2, 592.26, 220/592.24, 62.12, 62.18, 739, 592.23, 220/903; 229/403, 4.5

See application file for complete search history.

(56) References Cited

U.S. PATENT DOCUMENTS

| | | | | |
|---|---|---|---|---|
| 935,799 | A * | 10/1909 | Marthinson | 229/5.6 |
| 1,771,765 | A * | 7/1930 | Benson | 229/400 |
| 5,363,982 | A * | 11/1994 | Sadlier | 229/103.11 |
| 5,524,817 | A * | 6/1996 | Meier et al. | 229/403 |
| 5,752,653 | A * | 5/1998 | Razzaghi | 229/403 |
| 6,193,098 | B1 | 2/2001 | Mochizuki et al. | |
| 6,598,786 | B1 | 7/2003 | Guo | |
| 6,663,926 | B1 | 12/2003 | Okushita et al. | |
| 6,926,197 | B2 * | 8/2005 | Hed et al. | 229/403 |
| 7,552,841 | B2 | 6/2009 | Hollis et al. | |
| 2008/0041860 | A1 | 2/2008 | Wiedmeyer et al. | |
| 2008/0121681 | A1 | 5/2008 | Wiedmeyer | |

FOREIGN PATENT DOCUMENTS

| | | |
|---|---|---|
| WO | WO 2011/003569 | 1/2011 |

* cited by examiner

*Primary Examiner* — Fenn Mathew
*Assistant Examiner* — Jennifer Castriotta
(74) *Attorney, Agent, or Firm* — Baker Botts, L.L.P.

(57) ABSTRACT

Insulating cup includes an inner body and an outer body. The inner body has an inner sidewall defining a top opening and an inner bottom portion, and the inner sidewall includes a first circumferential rib and a second circumferential rib. The outer body has an outer sidewall surrounding at least a substantial portion of the inner sidewall and engaging the first circumferential rib and the second circumferential rib to define an insulating space therebetween, and the outer body has an outer bottom portion disposed below the inner bottom portion to define a surface-engaging edge.

15 Claims, 3 Drawing Sheets

INSULATING CUP

CROSS-REFERENCE TO RELATED APPLICATIONS

This application claims priority to U.S. Provisional Patent Application No. 61/642,886, filed May 4, 2012, which is incorporated by reference herein in its entirety.

BACKGROUND OF THE INVENTION

1. Field of the Invention

The present disclosed subject matter relates to a disposable cup for serving beverages, such as water and coffee, and food items, such as ice cream. Particularly, the present disclosed subject matter is directed to a cup having a multi-layer structure to provide improved insulating properties, among other benefits.

2. Description of Related Art

Some known types of disposable cups include those made from polystyrene, expanded polystyrene or paper. Although polystyrene cups can be aesthetically pleasing, they can have relatively poor insulating properties compared to other cups, and thus are mainly used for holding cold items. Condensation can form on the outside of a polystyrene cup containing a cold item, thereby making the cup wet, cold, and/or uncomfortable to use and/or hold for prolonged periods of time. The condensation can also make the polystyrene cup slippery, thus making the cup even more difficult and/or uncomfortable to hold. Further, polystyrene cups are generally not biodegradable or easily recyclable, and thus can be considered environmentally unfriendly.

Another type of cup, made from expanded polystyrene, or EPS (e.g., a Styrofoam® cup), can have improved thermal insulation properties compared to other cups, and thus can maintain the temperature of a drink, either hot or cold, for a longer amount of time. Expanded polystyrene cups can be relatively inexpensive, and can be comfortable to handle as the exterior of the cup remains relatively close to ambient temperature regardless of the temperature of the item inside the cup. However, expanded polystyrene is also generally not biodegradable or easily recyclable, and thus can also be considered environmentally unfriendly. Additionally, as expanded polystyrene cups are typically printed after they have been formed, and the relatively rough surface of the cup can be incompatible with high-resolution printing, relatively slow and costly processes are typically used for printing on expanded polystyrene cups.

Yet another type of disposable cups, made from paper, are generally recyclable and biodegradable, and thus can be considered environmentally friendly. However, paper cups, particularly single-layer paper cups, can have relatively poor thermal insulation properties, and thus, an item contained therein tends to maintain its temperature for a relatively short amount of time. Paper cups can also be uncomfortable to handle as a hot or cold drink can uncomfortably heat or cool a person's hand. Additionally, like polystyrene cups, a cold drink can cause condensation to appear on the outside of the paper cup, making the cup slippery and/or difficult to hold. Furthermore, paper cups constructed with a single wall or layer can be relatively fragile, and thus, paper cups can susceptible to weakening after exposure to liquids.

Multi-layer paper cups can provide improved thermal insulation and increased strength compared to single-layer paper cups. Multi-layer cups generally include an outer layer and an inner layer, and can include an insulating layer therebetween. Although relatively strong and thermally efficient, multi-layer cups can be relatively expensive if a more complicated manufacturing processes and excess material is required. Some examples of multi-layer cups, including paper cups, that attempt to address these concerns can be found in U.S. Pat. Nos. 7,552,841; 6,663,926; 6,598,786; and 6,193,098; U.S. Patent Application Publication Nos. 2008/0121681 and 2008/0041860; and International Publication No. WO2011/003569, the disclosure of each of which is incorporated by reference herein in its entirety. However, there remains an opportunity for improvement for a disposable cup that is strong, well-insulated and inexpensive to manufacture.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes an insulating cup comprising an inner body and an outer body. The inner body has an inner sidewall defining a top opening and an inner bottom portion, and the inner sidewall includes a first circumferential rib and a second circumferential rib. The outer body has an outer sidewall surrounding at least a substantial portion of the inner sidewall and engaging the first circumferential rib and the second circumferential rib to define an insulating space therebetween, and the outer body has an outer bottom portion disposed below the inner bottom portion to define a surface-engaging edge.

As embodied herein, the inner body can include a rolled top portion to define a rim about the top opening, and the rim can be disposed above the outer body proximate a top edge of the outer sidewall.

In some embodiments, the inner bottom portion can include a bottom wall, and the second circumferential rib can be disposed below the bottom wall. The bottom wall can be a separate member having a peripheral flange, and the second circumferential rib can be disposed proximate the peripheral flange. The peripheral flange can include a flange rib at least partially disposed within the second circumferential rib. Additionally or alternatively, the inner body can include an inwardly folded segment overlapping at least a portion of the flange, and the inwardly folded segment can include an inner rib at least partially disposed within the flange rib. The inwardly folded segment can also include a plurality of ridges.

In some embodiments, the first circumferential rib can be disposed proximate the top opening. The outer bottom portion can include an inwardly folded segment to define the surface-engaging edge.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Figure 1A:
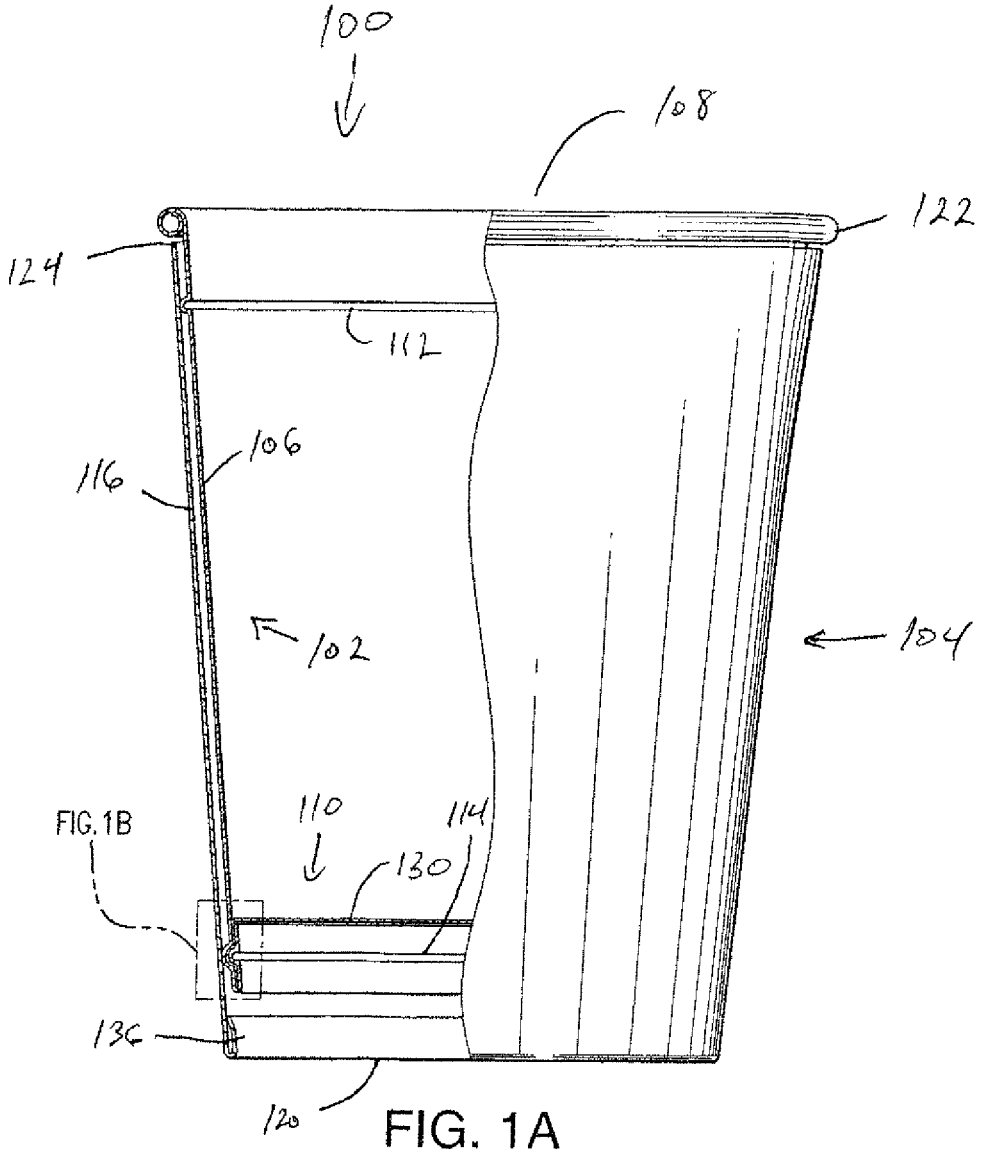
FIG. 1A is a partial cross-sectional front view of an exemplary insulating cup according to the disclosed subject matter, with a portion cut away for illustration.

The apparatus and methods presented herein may be used for serving, storage and transportation of beverages and food items, and other perishable and nonperishable products. The disclosed subject matter is particularly suited for serving, storage, and transportation of hot or cold beverages or food items, wherein the multi-layer configuration of the cup provides improved insulating properties to maintain the temperature of the beverage or food item contained therein during consumption, storage and/or transportation.

In accordance with the disclosed subject matter herein, the insulating cup includes an inner body and an outer body. The inner body has an inner sidewall defining a top opening and an inner bottom portion, and the inner sidewall includes a first circumferential rib and a second circumferential rib. The outer body has an outer sidewall surrounding at least a substantial portion of the inner sidewall and engaging the first circumferential rib and the second circumferential rib to define an insulating space therebetween, and the outer body has an outer bottom portion disposed below the inner bottom portion to define a surface-engaging edge.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the insulating cup in accordance with the disclosed subject matter are shown in FIGS. 1A-3. The insulating cup is suitable for use with a wide variety of perishable and nonperishable products. However, for purpose of understanding, reference will be made to the use of the insulating cup disclosed herein with beverages, wherein the insulating cup can be used for transporting, serving, storing, preparing and/or re-using such beverages. As described in further detail below, the insulating cup has suitable insulating properties to assist in maintaining the temperature of a beverage therein, and desirably, although not necessarily, can have venting properties to control the moisture level within the insulating cup. For purpose of illustration, and not limitation, reference will made herein to an insulating cup intended to contain a relatively hot beverage, such as hot water or coffer or other similar beverage, wherein the insulating cup has a multi-layer structure to provide improved insulating properties, among other benefits.

In the exemplary embodiment shown in FIG. 1A, the cup 100 generally includes an inner body 102 and an outer body 104. In this configuration, as illustrated, the cup 100 can have a generally frustoconical shape. Alternatively, the inner body 102 and outer body 104 can form a cup 100 having other geometric shapes, such as cylindrical, rectangular, triangular, or any suitable geometrical shape.

For purpose of illustration and not limitation, as shown in FIG. 1A, the inner body 102 is configured, for example, by wrapping a sheet of material to form an inner sidewall 106, which can define the inner circumference or periphery of the cup 100. The inner sidewall 106 defines a top opening 108 as embodied herein. A bottom portion of the inner body 102 can be folded toward the interior of the cup to form an inwardly folded segment 126, as described further below. Additionally, the inner body 102 includes an inner bottom portion 110, which can be formed from the sheet of material of the inner sidewall 106 to define a bottom wall 130 of the cup 100. Alternatively, the inner bottom portion 110 can be formed from a separate member, which can be secured to the inner body portion 102 to define the bottom wall 130 of the cup 100, as described further below. The inner sidewall 106 together with the bottom wall 130 define the inner volume of the cup 100.

The inner sidewall 106 includes a number of circumferential ribs 112, 114 extending outwardly away from the interior of the cup 100. As embodied herein, a first circumferential rib 112 and a second circumferential rib 114 are aligned substantially parallel and spaced apart a distance along the length of the inner sidewall 106. However, it is contemplated that a cup 100 according to the disclosed subject matter can have any suitable number of circumferential ribs 112, 114 having the features described herein. As shown in FIG. 1A, for purpose of illustration and not limitation, the first circumferential rib 112 is disposed proximate the top opening 108 and the rim 122, and the second circumferential rib 114 is disposed below the bottom wall 130 of the cup 100. Additionally, each circumferential rib 112, 114 can be provided with any of a variety of suitable shapes, such as sinusoidal or wave form, although a ring shape is depicted herein.

The outer body 104 is configured to form an outer sidewall 116. As embodied herein, the outer sidewall 116 can formed from a separate sheet of material from the inner body 102, for example by wrapping the separate sheet of material of the outer body 104 about the inner sidewall 106. The outer body 104 is secured to the inner sidewall 106 at at least one of the first circumferential rib 112 and the second circumferential rib 114. With the circumferential ribs 112, 114 extending to the outer sidewall 116 and secured thereto, an insulating space 118 can be formed between the inner sidewall 106 and the outer sidewall 116, and between the first circumferential rib 112 and the second circumferential rib 114.

As shown in FIG. 1A, the outer sidewall 116 surrounds a substantial portion of the inner sidewall 106. For example, and as embodied herein, a top edge 124 of the outer sidewall 116 can be disposed below the top opening 108 of the cup 100 and proximate to the rim 122. In accordance with one aspect of the disclosed subject matter, a bottom portion of the outer body 104 extends below the inner bottom portion 110 of the inner body 102 and defines a surface-engaging edge 120 of the cup 100. Further, the bottom portion of the outer body 104 can be folded toward the interior of the cup to form an inwardly folded segment 136 of the outer body 104 to increase the thickness and surface area of the surface-engaging edge 120. The inwardly folded segment 136 can be secured to the outer sidewall 116 for additional strength. Thus, the surface-engaging edge 120 is disposed to engage a flat surface supporting the cup 100 thereon, and in this manner, the outer body 104 can serve as the weight-bearing portion of the cup 100.

The inner bottom portion 110 can be formed as an integral portion of the inner body 102 as previously noted. For example, the material of the inner body 102 can be vacuum drawn or the like to form the inner sidewall 106 and inner bottom portion 110 as a single piece.

Figure 1B:
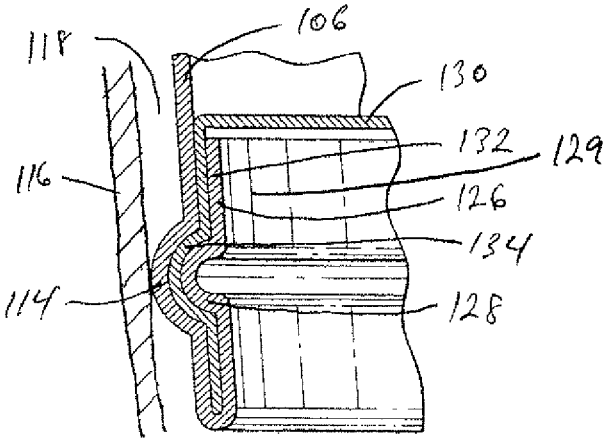
FIG. 1B is an enlarged cross-sectional detail view of a portion of the cross-section of FIG. 1A along detail line 1B.

As embodied herein, however, and as best shown in the enlarged view of FIG. 1B, the inner bottom portion 110 forming the bottom wall 130 is configured as a separate member secured to the inner body 102. In this configuration, the inner bottom portion 110 has a peripheral flange 132 extending from the periphery of the bottom wall 130, and the peripheral flange 132 can be secured between the inwardly folded segment 126 and the inner sidewall 106 of the inner body 102. The inwardly folded segment 126 can include a plurality of ridges 129 or corrugations to facilitate adhesion of the inwardly folded segment 126 to the inner sidewall 106 or the peripheral flange 132. Likewise, the inner sidewall 106 and/or the peripheral flange 132 can include a plurality of ridges or corrugations at the point of attachment of the inwardly folded segment 126 thereto.

As further shown in the enlarged view of FIG. 1B, the second circumferential rib 114 can be disposed proximate the inwardly folded segment 126, and the inwardly folded segment can include an inner rib 128, which is at least partially disposed within the second circumferential rib 114. Where the inner bottom portion 110 is configured as a separate member, as shown in FIG. 1B, the second circumferential rib 114 can be disposed proximate the peripheral flange 132. In this configuration, the peripheral flange can include a flange rib 134, which can be at least partially disposed within the second circumferential rib 114, and the inner rib 128 of the inwardly folded segment 126 can be disposed at least partially within the flange rib 134.

The insulating space 118 formed as described above provides a region of insulation between the contents of the cup 100 in the volume of the inner body 102 and the air surrounding the outer body 104 to reduce thermal flow therebetween. The insulating space 118 can be filled with a suitable gas, such as air, or can be filled with a variety of suitable materials to achieve desired insulating properties. For example, material within the insulating space 118 can include paperboard, polymeric sheets, foil or metalized film, foam sheets (e.g., expanded polystyrene), a water-soluble (e.g., starch-based) material, a foamed heat-insulating layer or coating (e.g., polyethylene, polyolefin, polyvinylchloride, polystyrene, polyester, or nylon), combinations thereof, or the like.

The inner body 102 and outer body 104 can be formed of various types of suitable materials. Non-limiting examples of materials that may be used to form the inner body 102 and/or outer body 104 include unscored paperboard such as chipboard (plain chip or bending chip), linerboard, virgin paperboard, paperboard with recycled content, SBS board, SUS board, polymeric solid sheets, combinations thereof, or the like. The inner body 102 and/or outer body 104 can further include of foil or metalized film laminated paperboard, porous sheets, foam sheets (e.g., expanded polystyrene), combinations thereof, or the like. Alternatively or additionally, some or all of the inner body 102 and/or outer body 104 can be coated with a waterproof coating including, for example, polyethylene.

Although the thickness of the inner sidewall 106 and outer sidewall 116 generally depends on the type and/or application of the resulting cup 100, the thickness of the inner sidewall 106 and outer sidewall 116 can generally be from about 1 mil to about 20 mils. Although not shown in the illustrated embodiments, the inner body 102 and/or outer body 104 can include additional surface features, such as ribs, dimples, corrugations, scores, or the like and combinations thereof, or the like for aesthetics, gripping or other desired characteristics.

Figure 2:
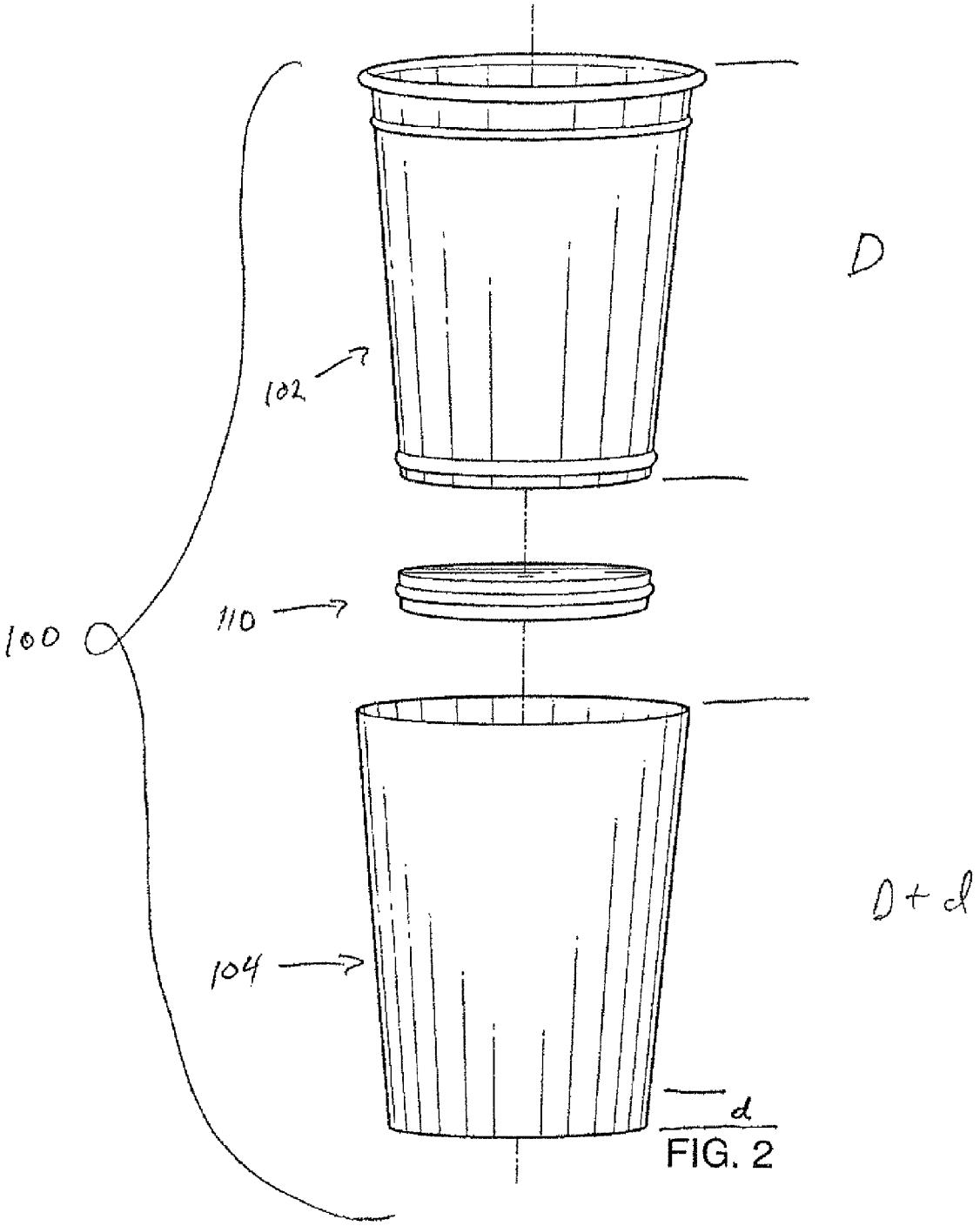
FIG. 2 an exploded front view of the insulating cup of FIG. 1A.

For purpose of illustration of another aspect of the disclosed subject matter, FIG. 2 shows an exploded front view of the cup 100 of FIG. 1A. As embodied herein, the inner body 102 can have a height D, and the outer body 104 can have a height D+d. Thus, the outer body 104 can have a height greater than the inner body 102, so as to allow the outer body 104 to serve as the weight bearing portion of the cup 100, while at the same time providing an insulating space 118 about substantially the entirety of the interior of the cup 100. Additional strength and support in the weight bearing portion can be provided by surface contact between the inwardly folded segment 136 of the outer body 104 and the inner bottom portion 110 of the inner body 102, and/or surface contact between the top edge 124 of the outer sidewall 116 of the outer body 104 and the rim 122 of the inner body 102. FIG. 2 is shown with the inner bottom portion 110 configured as a separate member, however, as described above, the inner bottom portion 110 can be integrally formed with the inner body 102. Any of a variety of known manufacturing techniques or processes can be used for each component of cup 100 and assembly of cup 100 therefrom.

Figure 3:
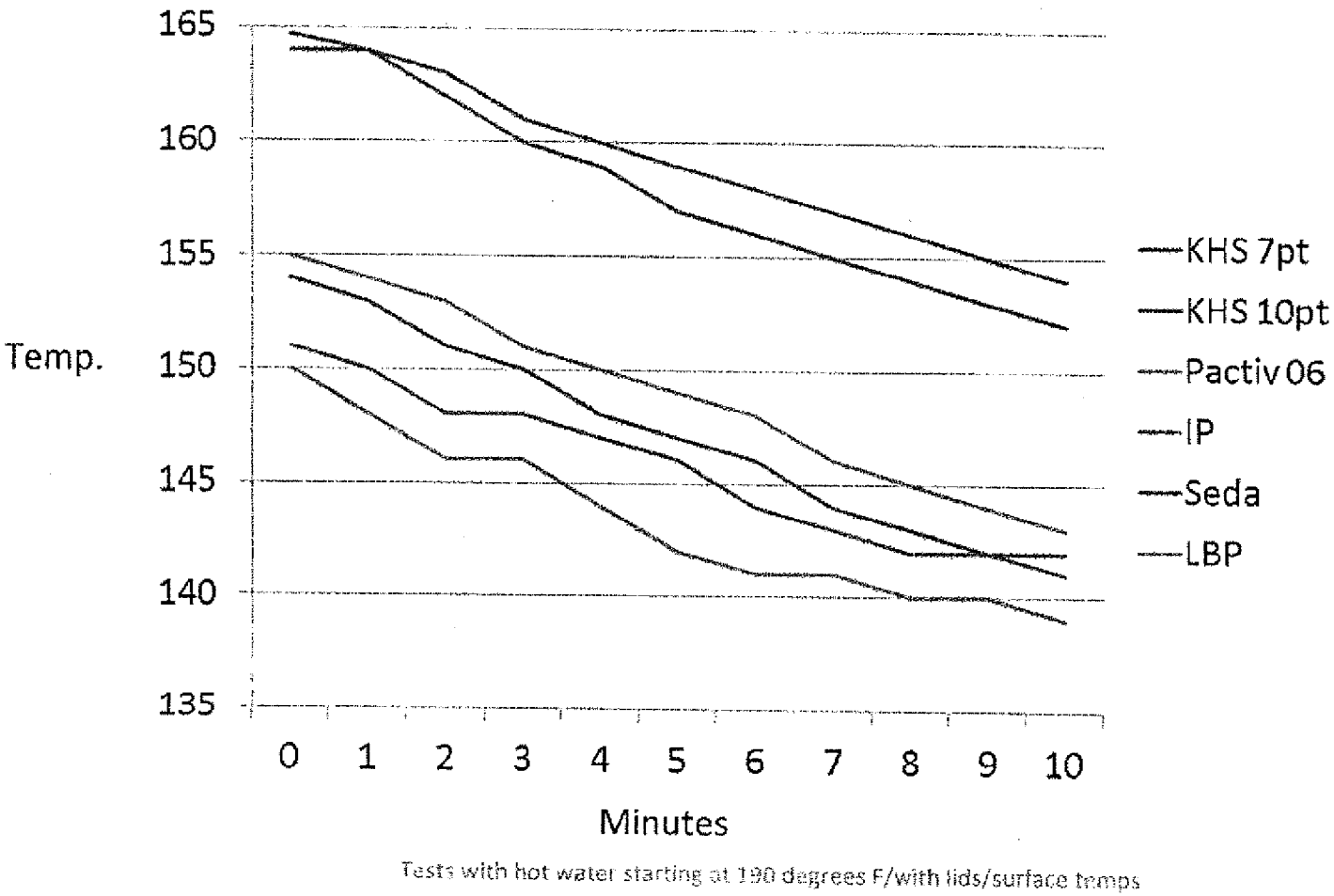
FIG. 3 is a diagram demonstrating further aspects of the insulating cup of FIG. 1A.

In accordance with another aspect of the disclosed subject matter, Table 1 and FIG. 3 demonstrate the insulating properties of a cup 100 according to the disclosed subject matter (denoted here as Pactiv 06) as compared to other known cups. Water at 190 degrees Fahrenheit was placed in each cup and the temperature was measured over a 10 minute period. Table 1 shows the temperature in degrees Fahrenheit of the water in 1 minute intervals over the 10 minute period. FIG. 3 shows the data of Table 1 in a line graph. As can be seen in Table 1 and FIG. 3, the insulating properties of the cup 100 are at least comparable to or improve upon other known cups.

TABLE 1

| | Time (Minutes): | | | | | |
|---|---|---|---|---|---|---|
| Cup | 0 | 1 | 2 | 3 | 4 | 5 |
| Pactiv 06 | 155 | 154 | 153 | 151 | 150 | 149 |
| KHS 7 pt | 165 | 164 | 163 | 161 | 160 | 159 |
| KHS 10 pt | 164 | 164 | 162 | 160 | 159 | 157 |
| IP | 154 | 153 | 151 | 150 | 148 | 147 |
| LBP | 150 | 148 | 146 | 146 | 144 | 142 |
| Seda | 151 | 150 | 148 | 148 | 147 | 146 |
| | Time (Minutes): | | | | | |
| Cup | 6 | 7 | 8 | 9 | 10 | |
| Pactiv 06 | 148 | 146 | 145 | 144 | 143 | |
| KHS 7 pt | 158 | 157 | 156 | 155 | 154 | |
| KHS 10 pt | 156 | 155 | 154 | 153 | 152 | |
| IP | 146 | 144 | 143 | 142 | 142 | |
| LBP | 141 | 140 | 140 | 139 | 138 | |
| Seda | 145 | 144 | 143 | 142 | 141 | |

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. An insulating cup comprising:

an inner body comprising an inner sidewall defining a top opening and an inner bottom portion, the inner sidewall including a first circumferential rib and a second circumferential rib; and an outer body comprising an outer sidewall surrounding at least a substantial portion of the inner sidewall and engaging the first circumferential rib and the second circumferential rib to define an insulating space therebetween; the outer body having an outer bottom portion including an inwardly folded segment disposed below and spaced a distance from a lowermost edge of the inner body to define a surface-engaging edge.

2. The insulating cup of claim 1, wherein the inner body further comprises a rolled top portion to define a rim about the top opening.

3. The insulating cup of claim 2, wherein the rim is disposed above the outer body proximate a top edge of the outer sidewall.

4. The insulating cup of claim 1, wherein the inner bottom portion includes a bottom wall.

5. The insulating cup of claim 4, wherein the second circumferential rib is disposed below the bottom wall.

6. The insulating cup of claim 4, wherein the bottom wall is a separate member having a peripheral flange.

7. The insulating cup of claim 6, wherein the second circumferential rib is disposed proximate the peripheral flange.

8. The insulating cup of claim 6, wherein the peripheral flange comprises a flange rib at least partially disposed within the second circumferential rib.

9. The insulating cup of claim 8, wherein the first inner body comprises an inner inwardly folded segment overlapping at least a portion of the flange.

10. The insulating cup of claim 9, wherein the inner rib is at least partially disposed within the flange rib.

11. The insulating cup of claim 9, wherein the inner inwardly folded segment comprises a plurality of ridges.

12. The insulating cup of claim 1, wherein the first circumferential rib is disposed proximate the top opening.

13. The insulating cup of claim 1, wherein the inner bottom portion includes an inner inwardly folded segment defining an inner rib, the inner rib disposed at least partially within the second circumferential rib.

14. The insulating cup of claim 13, wherein the inner inwardly folded segment comprises a plurality of ridges.

15. The insulating cup of claim 13, wherein the second circumferential rib is disposed proximate the inner inwardly folded segment.

* * * * *